US005181288A

United States Patent [19]

Heaton et al.

[11] Patent Number: 5,181,288

[45] Date of Patent: Jan. 26, 1993

[54] THERAPEUTIC TURNING BED

[75] Inventors: Keith P. Heaton; Kenneth W. Hunt, both of Dorset; Rutland S. Boughton, Gloucestershire, all of England

[73] Assignee: The Mediscus Group Inc., Akron, Ohio

[21] Appl. No.: 687,080

[22] Filed: Apr. 18, 1991

Related U.S. Application Data

[63] Continuation of Ser. No. 529,453, May 29, 1990, abandoned.

[30] Foreign Application Priority Data

May 30, 1989 [GB] United Kingdom ..... 8912369
Dec. 22, 1989 [GB] United Kingdom ..... 8929102

[51] Int. Cl.[5] ..... A61G 7/00

[52] U.S. Cl. ..... 5/607; 5/609; 5/453; 5/914

[58] Field of Search ..... 5/60-64, 5/953, 607, 609

[56] References Cited

U.S. PATENT DOCUMENTS

| | | | |
|---|---|---|---|
| 3,284,815 | 11/1966 | Grossman et al. | 5/62 |
| 3,426,373 | 2/1969 | Scott et al. | 5/456 |
| 3,739,406 | 6/1973 | Koetter | 5/62 X |
| 4,638,519 | 1/1987 | Hess | 5/469 X |
| 4,658,450 | 4/1987 | Thompson | 5/62 X |
| 4,856,128 | 8/1989 | Alsip et al. | 5/61 |
| 5,023,967 | 6/1991 | Ferrand | 5/62 |

FOREIGN PATENT DOCUMENTS

| | | | |
|---|---|---|---|
| 8606024 | 11/1986 | PCT Int'l Appl. | 5/453 |
| 8809651 | 12/1988 | PCT Int'l Appl. | 5/453 |

OTHER PUBLICATIONS

Kinetic Therapy Programme, Ethos Medical, Athlone, Ireland (brochure).
Luftdrehbett, Sacon Deutschland GmbH (brochure).
Turning and Tilting Bed, Mark 2, Egerton Hospital Equipment, Ltd., Horsham, England (brochure).
Kinetic Concepts, Inc., San Antonio, Tex. (Brochure).
Egerton, Egerton Hospital Equipment, Ltd., Horsham, England (brochure).
The Egerton Turning and Tilting Bed, Mark 2, Egerton Hospital Equipment, Ltd., Horsham, England (brochure).
The Sacon Tilting Bed, Sacon AG (brochure).
"New Appliances, Roto-Rest", *British Medical Journal,* Sep. 16, 1967, pp. 731-733.

*Primary Examiner*—Michael F. Trettel
*Attorney, Agent, or Firm*—Amster, Rothstein & Ebenstein

[57] ABSTRACT

The present invention provides a therapeutic bed which comprises:

(a) a trolley frame (1) having floor-engaging feet or wheels (2), (b) an attitude frame (3) pivotably mounted on the trolley frame so as to be pivotable through a predetermined arc about an axis extending longitudinally of the bed, (c) operating means (62, 67 & 64) for causing the attitude frame to pivot in one direction and then the other through said predetermined arc, (d) a plurality of air sacs (14) supported on said attitude frame and inflatable to a pressure sufficient to provide a resilient surface for supporting a patient thereon, said air sacs together forming a shaped cavity (31, 32, 33) within which the patient's body can be nested and supported so that the patient does not slide off the bed during turning, and (e) microprocessor control means for causing the turning movement of the attitude frame to be arrested when reaching the end of the predetermined movement in one direction and causing the operating means to reverse the direction of turning movement.

9 Claims, 7 Drawing Sheets

THERAPEUTIC TURNING BED

This application is a continuation of now abandoned application Ser. No. 07/529,453, filed on May 29, 1990, now abandoned.

BACKGROUND OF THE INVENTION

This invention relates to therapeutic beds, which are principally of the so-called "low air loss" type and which facilitate the nursing of hospitalised patients.

DESCRIPTION OF THE PRIOR ART

In low air loss beds, the patient is supported on a number of inflated sacs whose pressures are adjusted so as to maximise the area over which the patient's weight is supported, thereby minimising the skin Contact pressures. Typical references describing conventional low air loss beds (hereinafter LALB's) are GB Patent No. 1474018 and U.S. Pat. No. 4,525,885. Low air loss beds have been very successful clinically in nursing patients who are prone to development of pressure sores.

Bed-ridden and immobile patients also tend to suffer from lung congestion and have to be turned at regular intervals in order to assist drainage of fluid from the lungs. Normally, this is performed manually by nurses, who physically turn the patient at on to two hour intervals.

Although powered turning beds exist, these are primarily designed for spinal injury patients and are designed so that the patient is tightly confined. In such powered turning beds, the patient is turned slowly through an angle of up to 60° in each direction, and the patient is wedged between blocks of foam and strapped to a firm baseboard. This tightly confined condition is found by many patients to be very unpleasant, can induce nausea and encourage the development of bed sores unless the patient's condition is constantly monitored.

SUMMARY OF THE INVENTION

According to one of its aspects, the present invention provides a therapeutic bed which comprises:

(a) a trolley frame having floor-engaging feet or wheels, (b) an attitude frame pivotably mounted on the trolley frame so as to be pivotable through a predetermined arc about an axis extending longitudinally of the bed, (c) operating means for causing the attitude frame to pivot through said predetermined arc, (d) a plurality of air sacs supported on said attitude frame and inflatable to a pressure sufficient to provide a resilient surface for supporting a patient thereon, said air sacs together forming a cavity within which the patient's body can be nested and supported so that the patient does not slide off the bed during turning, and (e) control means for causing the turning movement of the attitude frame to be arrested when reaching the end of the predetermined movement in one direction and causing the operating means to reverse the direction of turning movement.

The operating means for effecting the pivoting movement will normally include control means, such as a microprocessor, which can be programmed to control the rate of pivoting movement, the dwell time at the extreme point of the pivoting movement and the angle through which the attitude frame is pivoted. In practice, we have found that for the best clinical effect, the attitude frame should be pivoted through a total arc of at least about 40° (i.e. 20° in each direction), and that a total pivoting arc may be as much as 80° without losing stability.

Dwell times at the extreme point in the cycle may vary from a few seconds to 30 minutes but is preferably between about 1 and 5 minutes.

In order to maintain the patient in a stable position in the bed with the minimum of straps or other restraining devices, the operative surface of the bed is preferably made up of a plurality of individual inflatable air sacs, which are shaped to produce a cavity corresponding to the silhouette of the patient. Thus, the patient can be snugly nested in the air sacs while being supported at minimum skin contact pressures.

Preferably, the air sacs are made partly or wholly from water vapour permeable material, which is however impermeable to liquids. By using such materials and ensuring that an air flow takes place within the sacs, water vapour is induced to pass into the sacs and is swept away in the air stream. In this way, the condition of the patient's skin and his comfort generally is improved. The operation of water vapour permeable LALB's and the selection of suitable water vapour permeable materials is described in GB Patent No. 1474018, U.S. Pat. No. 4,525,885, U K. Patent Specification No. 2141333, WO 86/06624, U.S. Pat. No. 3,822,425 and "Bed Sore BioMechanics", edited by R. H. Kennedy, J. M. Cowden and J. T. Seales, published by Macmillan 1976, pages 259–299, the disclosure of all of the above publications being specifically incorporated herein by reference. Examples of commercially available water vapour permeable materials are 'Permatex' manufactured by Carrington & Dewhurst Performance Fabrics and 'Gortex' manufactured by W. L. Gore & Associates.

Further improvements in patient comfort are achieved by providing a heater in the air supply to the sacs and also exhaust regulation valves, to control the air flow in the sacs, as described in the above cited references, all of which are specifically incorporated herein.

Although the operating means for pivoting the attitude frame may be selected from a variety of systems, e.g. inflatable air bags (which can be repetitively filled and exhausted) or hydraulic rams acting between the trolley frame and the attitude frame, such methods have various disadvantages. It has been found that the most effective operating means comprises a direct mechanical linkage between the relatively movable components, i.e. the attitude frame and the trolley frame. The mechanical linkage may be a pinion drivably connected to an electric motor which is arranged to mesh with a toothed gear or quadrant, the pinion and toothed gear or quadrant being mounted respectively on the relatively movable frame components. Where the motor can be operated at low rpm, the pinion can be mounted directly on the motor shaft. However, in order to provide sufficient torque from a motor of compact dimensions, it is normally necessary to drive the attitude frame through a gear box. In an alternative mechanical drive arrangement, the electric motor may be coupled to a worm, (normally through a gear box) the worm being engaged with a worm wheel mounted on the other relatively movable component.

The various features of the improved turning bed will become apparent from the following description and accompanying drawings.

BRIEF DESCRIPTION OF THE DRAWINGS

Referring to the drawings, the general appearance and basic functions of the bed are shown in FIGS. 1*a* to d, and FIG. 2. The bed has a trolley frame (1) which is fitted with ground-engaging castors (2) and supports an attitude frame (3). Attitude frame (3) is supported from the trolley frame (1) by means of actuating arms (4 & 5) which can be raised and lowered separately or in unison by actuators (15 & 16). As can be seen in FIGS. 1*a* and 1*c*, operation of the actuators (15 & 16) in unison cause the attitude frame (3) to be raised or lowered in a horizontal plane while FIG. 1*b* shows that if actuator (16) is extended while actuator (15) is retracted, attitude frame (3) takes up the Trendelenberg position. The opposite movement of actuators (15 & 16) causes the attitude frame to be tilted into the reverse Trendelenberg position.

Figure 1B:
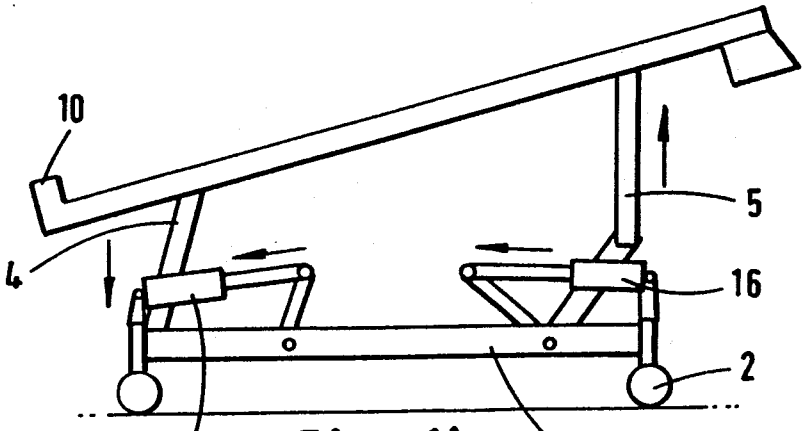
FIGS. 1*a*, 1*b*, 1*c* and 1*d* are schematic views of the bed showing the various attitudes and functions.
Figure 1D:
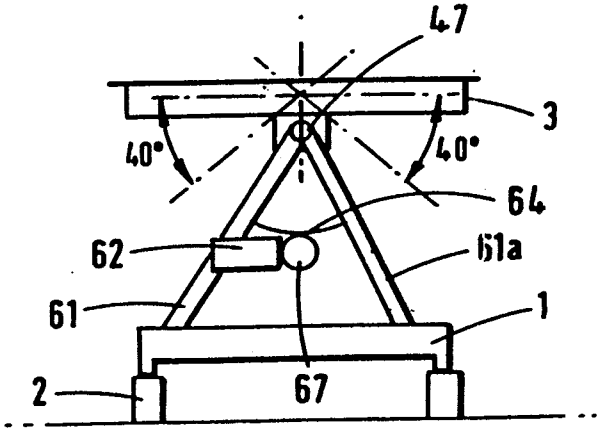
Figure 1A:
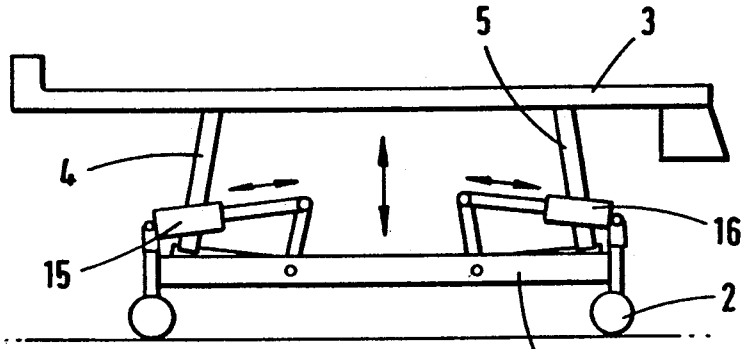
Figure 1C:
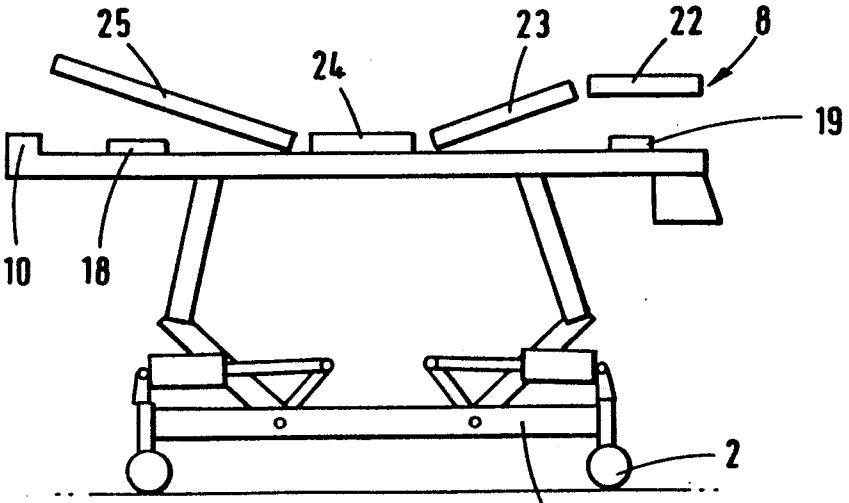
Figure 9:
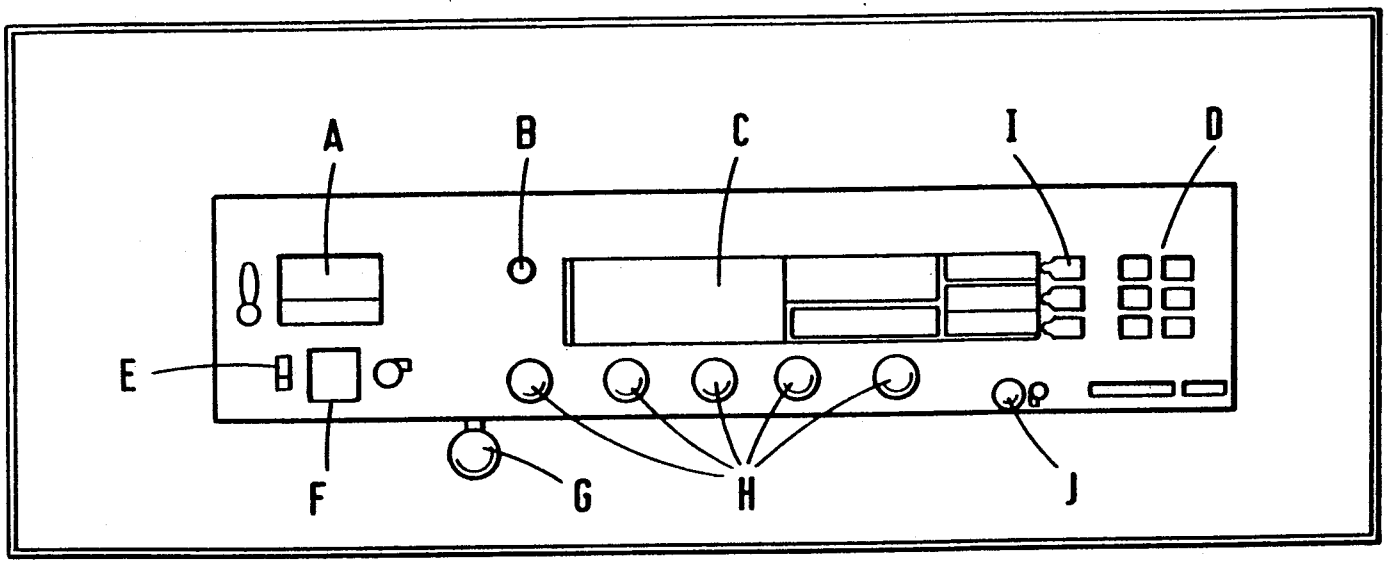
FIG. 9 is a diagrammatic view of the control panel and display arrangements for the bed.
Figure 10:
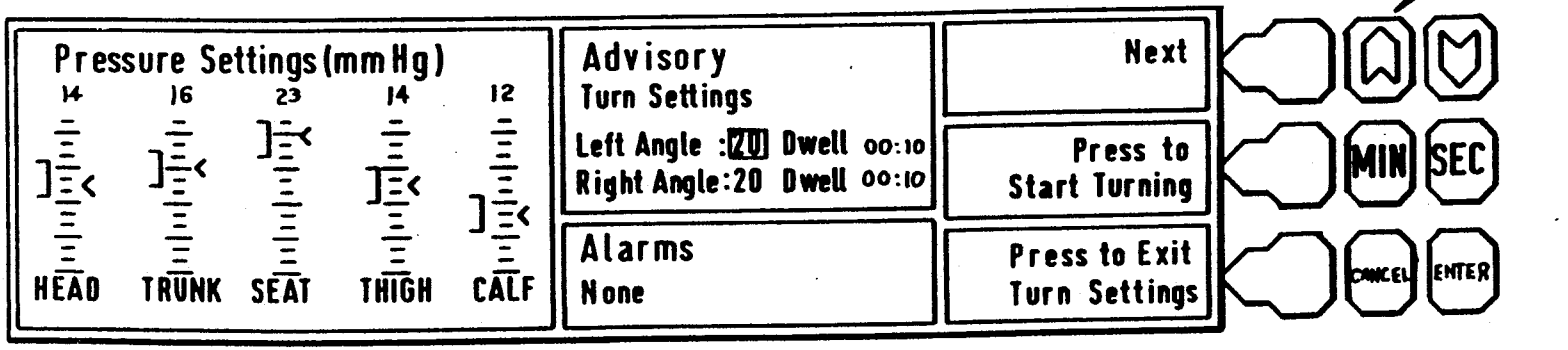
FIG. 10 is an example of the information which can be shown on the display screen.
Figure 11:
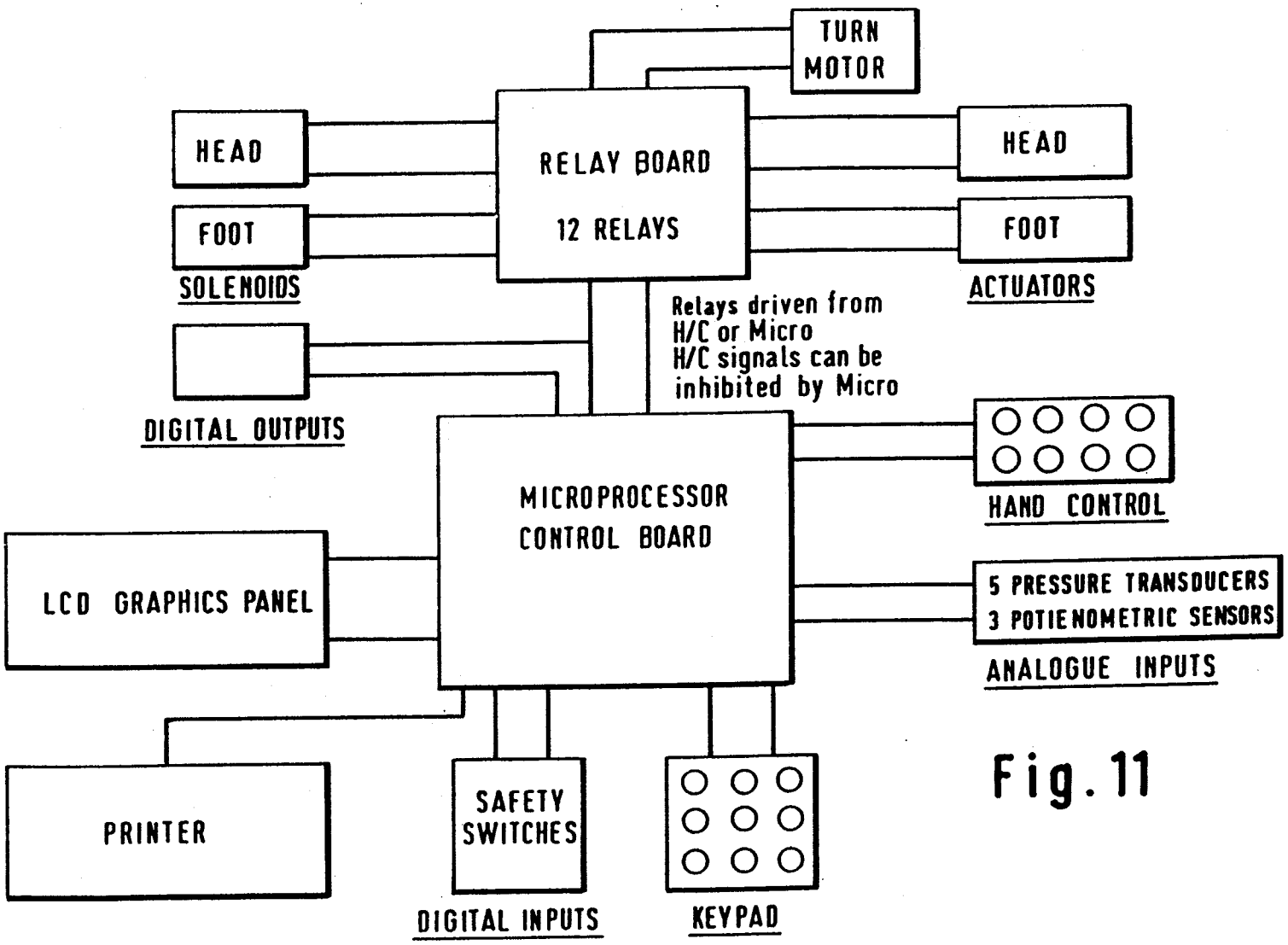
FIG. 11 is a diagrammatic layout of the control system for the bed.

As shown schematically at (18 & 19) in FIG. 1*c*, the attitude frame is fitted with potentiometric sensor means to determine when sao sections 22, 23, 24 and 25 (which together form the contour frame 8) are flat on the attitude frame (3). The sensor means are 2 of the 3 analogue inputs shown in FIG. 11. They are effectively variable resistors, one component being linked to the head or foot sections (22 or 25) and the other to the frame 3. As indicated in FIG. 11, the sensors (18 & 19) are connected via a relay board to the microprocessor control board, so that the position of the sac sections can be monitored. Thus, there will be a voltage drop across the resistor whose value depends on the extent of pivoting of section 22 or 25. This voltage change is converted by the microprocessor to an angular display on screen C (FIGS. 9 to 11). This is important since the turning operation, which is indicated schematically in FIG. 1*d*, should not commence with the sac sections in a fully contoured condition. However, it is generally safe to operate with the head or foot section raised by about 10° to 20°.

FIG. 1*d* shows diagrammatically the principle whereby the attitude frame (3) is pivotable about a longitudinal axis of the bed through a maximum angle in each direction of about 40°. As shown schematically in FIG. 1*d*, the arm (4) at the head end (10) takes the form of an A-frame (61, 61*a*), whose legs are attached to a pair of levers (45). Levers (45) are linked to actuator (15) so that extension of the actuator causes the A-frame to rise (see FIG. 6). At its apex, the A-frame is pivotably connected to the attitude frame (3) at (47) so that the attitude frame is pivotable on the A-frame about an axis, which extends longitudinally of the bed. Supported on the attitude frame (3) so as to be pivotable with the attitude frame is a drive motor (62). Motor (62) drives a pinion (67) which meshes with a quadrant shaped gear (64) fixed to the A-frame so that on operation of the motor, the attitude frame is tilted about the longitudinal axis of the bed with respect to the A-frame.

Figure 2:
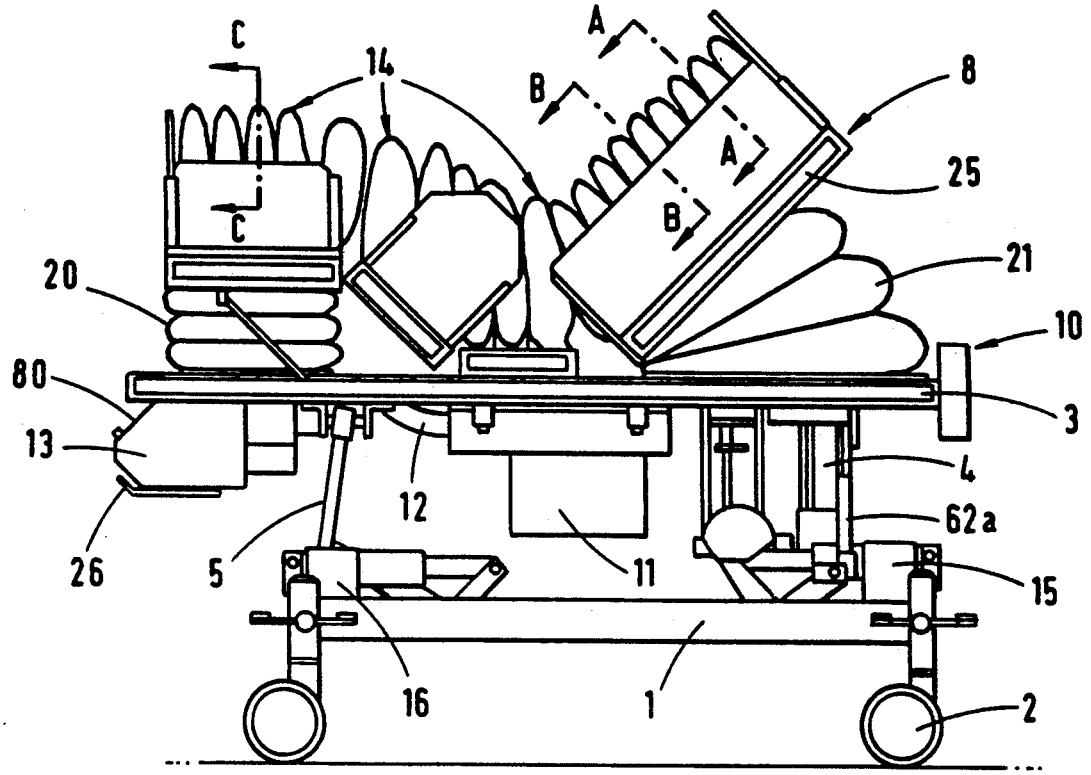
FIG. 2 is a side elevation of an embodiment of the bed showing the attitude frame in the fully raised position and the head and foot sections of the contour frame fully raised.
Figure 3A:
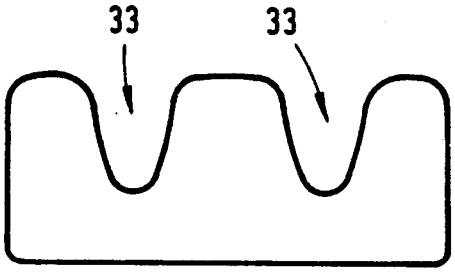
FIGS. 3*a*, 3*b* and 3*c* show the shapes of profiled air sacs when viewed along the sections A—A, B—B and C—C in FIG. 2.
Figure 3B:
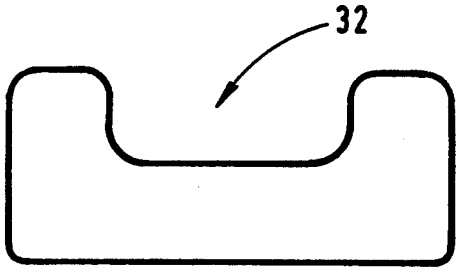
Figure 3C:
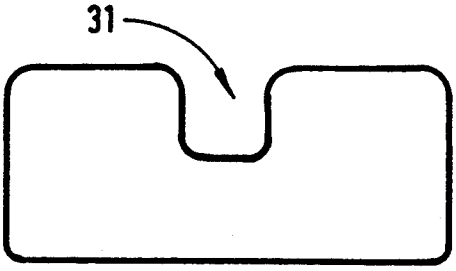

Referring particularly to FIG. 2, attitude frame (3) has suspended beneath it a blower housing (11) which is connected via trunking (12) to a control box (13) which incorporates valve gear for controlling the flow of pressurised air to individual air sacs (14) and also for supplying air to bellows (20 & 21) for raising and lowering the foot and head of the bed sections which form the contour frame (8). The bed sections forming the contour frame are linked together by appropriate hinges (not shown), except for the head section (25) of the contour frame (8) which incorporates a sliding hinge which slides on the attitude frame (3). The general arrangement of the air sac air flow control means, CPR emergency release handle (26) are generally as described in our published PCT application WO 86/06624 and corresponding U.S patent application 07/002,766, the disclosure of which is specifically incorporated herein by reference. As previously mentioned, the air sacs (14) are not all of the same shape, although they are generally of a lozenge shape and are removably attached to the sections forming the contour frame (8). In order to provide the nesting cavities within which the patient can be supported, the air sacs are shaped as shown in FIGS. 3A to 3C. As can be seen from the end views of these air sacs, their surfaces are profiled according to their location in the patient support surface formed by the contiguous air sacs. The air sac shown in FIG. 3C is shaped by stitching or gluing to provide an upper surface with a single gap (31) suitable for supporting the head of the patient whereas the air sac (3B) which is located further down the head section of the contour frame is provided with a bigger gap in its top surface (32) for accommodating the shoulders of the patient. In a similar manner, the air sac shown in FIG. 3A incorporates two depressions (33) in its top surface within which the patient's legs can be lifted. It will be appreciated that differently shaped air sacs or air sacs of different dimensions may be selected and fitted to the contour frame depending on the size and weight of the patient.

The mechanism for raising and lowering the patient support surface of the bed and for pivoting the attitude frame about its longitudinal axis is shown in detail in FIGS. 4, 4A to D, 5, 6, 7 and 8.

Figure 4A:
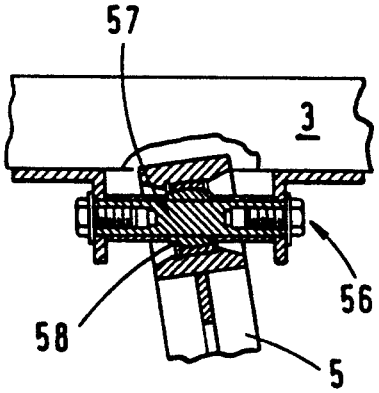
FIGS. 4*a*, 4*b*, 4*c* and 4*d* show details of the linkages between the trolley frame and the attitude frame and are respectively enlarged views of the areas circled by A & B in FIG. 4 and sections taken on the lines B—B and D—D in FIG. 4.
Figure 4B:
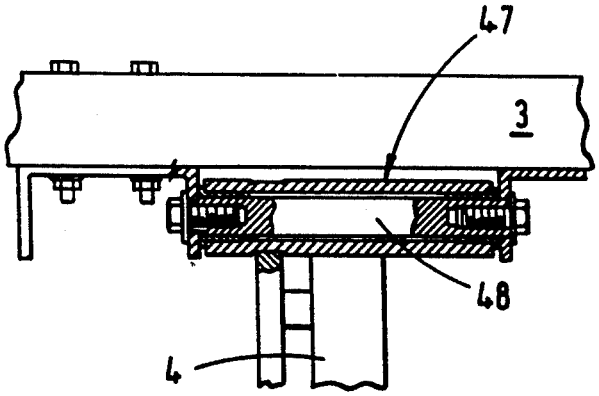
Figure 4C:
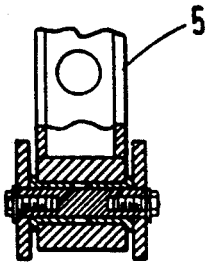
Figure 4D:
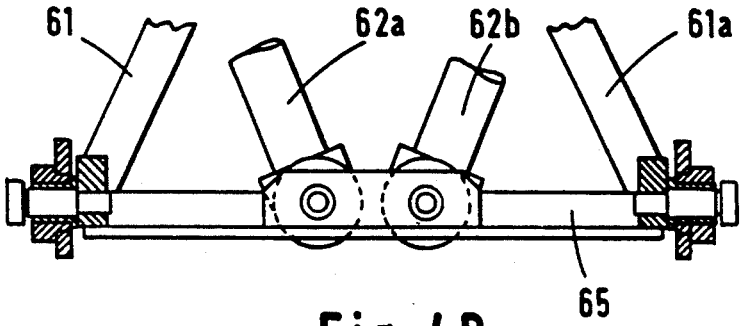
Figure 4:
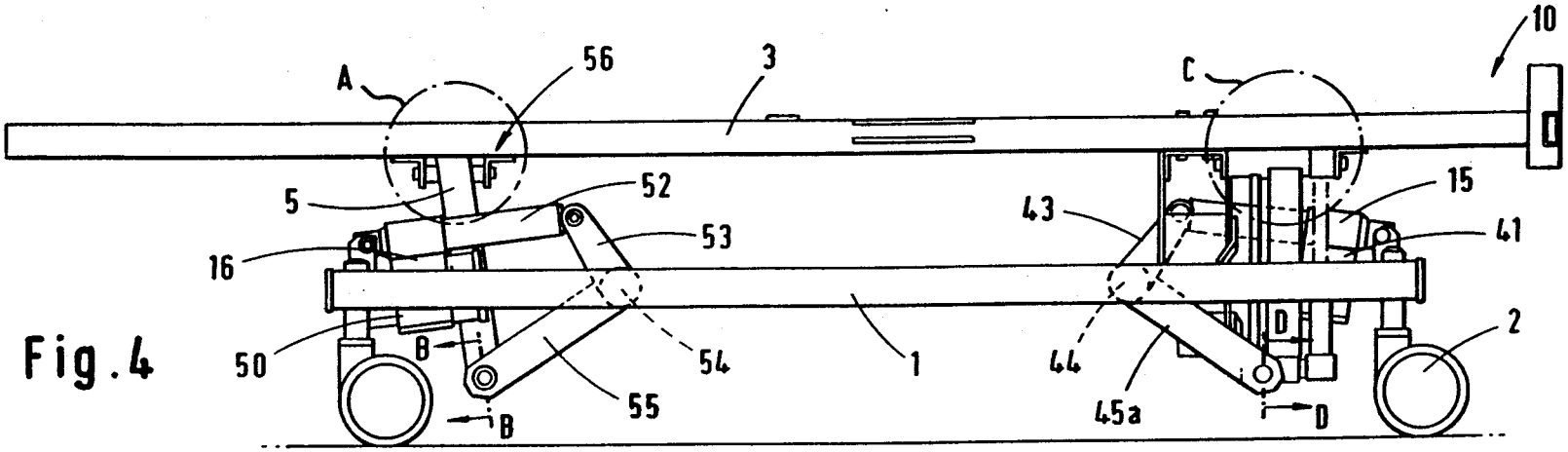
FIG. 4 is a side elevation of the trolley frame and attitude frame showing the actuators and associated parts for raising and lowering the attitude frame.
Figure 6:
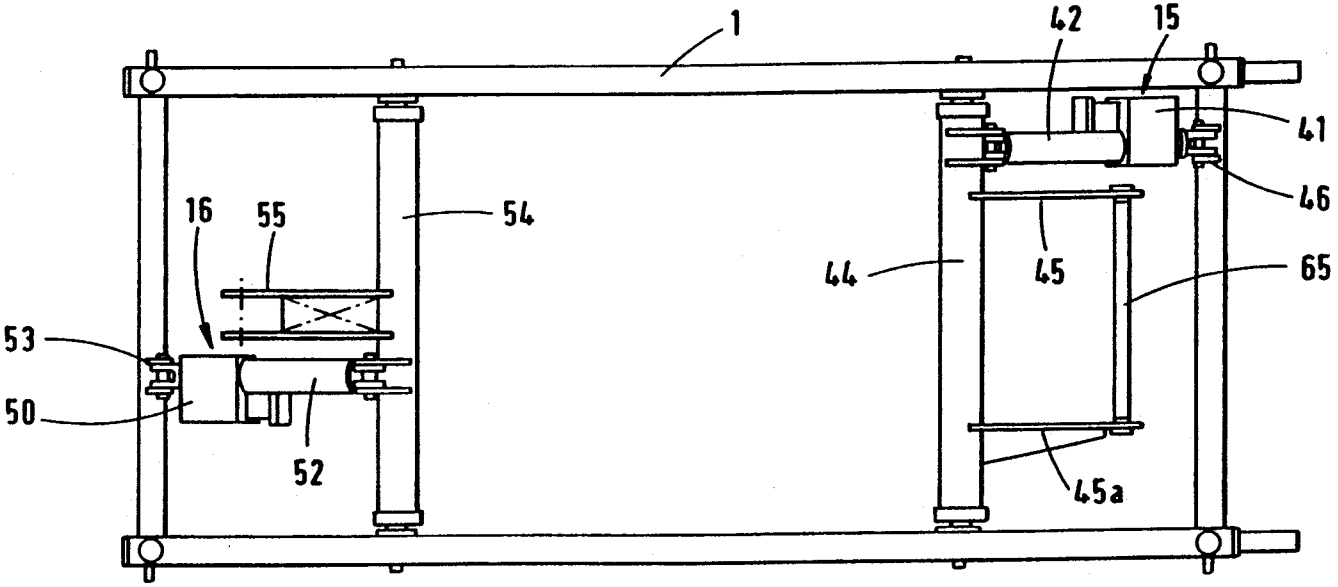
FIG. 6 is a plan view of the trolley frame.

Referring particularly to FIGS. 4 and 6, the actuator (15) includes an electric motor (41) drivably engaging a threaded lead screw (42). To the free end of lead screw (42) is pivotably connected a lever (43). Lever (43) is fixedly attached to a shaft (44) mounted in the trolley frame (1). A pair of spaced levers (45 & 45*a*) are also fixedly attached at one end to shaft (44) and at their outer end pivotably connected to the lower end of actuating arm (4). As mentioned above, actuating arm (4) is in the form of an A-frame having legs (61 & 61*a*). The lower ends of the A-frame (4) are joined by a shaft (65), the ends of which are received in bearings in the outer ends of levers (45 & 45*a*).

Figure 5:
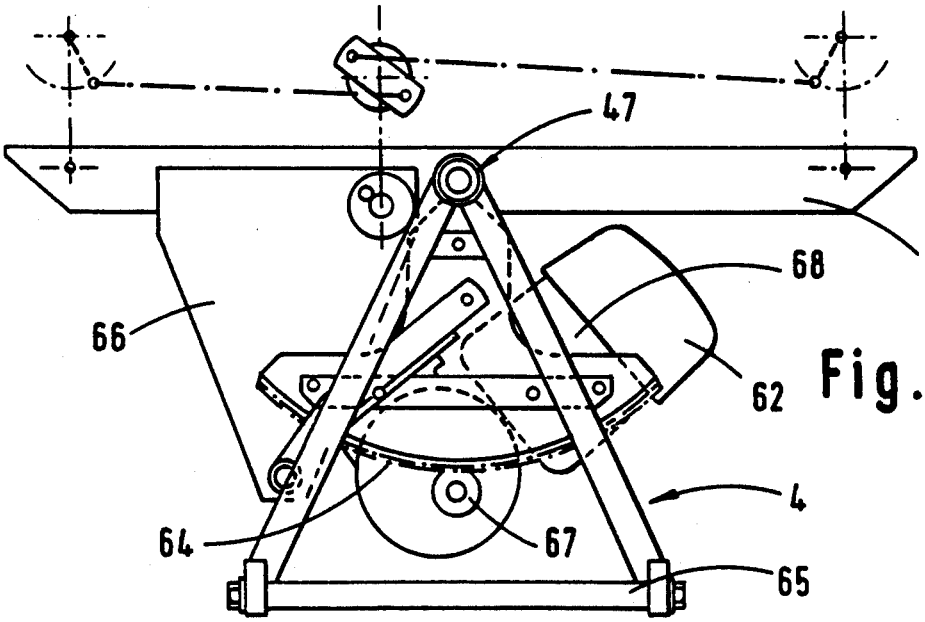
FIG. 5 is a partial end elevation showing the manner in which the motor for pivoting the base frame is mounted.

As best seen in FIG. 4*b* and FIG. 5, the apex of the A-frame (4) is welded at its upper end to a trunnion (47) within which is mounted, within a suitable bearing, a shaft (48). As a result, attitude frame (3) is able to rotate about shaft (48) which comprises the longitudinal pivoting axis of the bed.

At its opposite end from lead screw (42) actuator (15) is pivotably attached to a bracket (46) mounted on the trolley frame (1). Thus, when lead screw (42) is extended, levers (43, 45 & 45*a*) act together as a bell crank lever causing shaft (44) to rotate in an anti-clockwise direction and actuating arm (4) to rise.

A similar arrangement is provided at the foot end of the bed where actuator (16) incorporates a motor (50) and lead screw (52). The actuator (16) is anchored to the trolley frame (1) by bracket (53) and at the other end is pivotably connected to a lever (53) whose remote end is fixed angularly to a shaft (54), which is pivotably mounted within frame (1). Shaft (54) also carries an angularly fixed lever (55), to the opposite end of which is pivotably attached arm (5). At its upper end, arm (5) is rotatably secured within a trunnion (56) mounted on the underside of the attitude frame (3). Details of construction of trunnion (56) are shown in FIG. 4A, from which it will be seen that the trunnion incorporates a universal joint (58) which enables pivoting movement of the attitude frame (3) about shaft (57) as well as limited angular movement between arm (5) and the plane within which attitude frame (3) lies. FIG. 4C shows the bearing located between arm (5) and lever (55). In order to bias the attitude frame (3) into a horizontal position compression springs (62*a* & *b*) extend between the attitude frame (3) and the cross shaft (65). As an alternative, other means of damping or biasing the movement of the attitude frame may be employed such as gas struts in place of the springs. Only one end of the gas struts or springs is fixed so that they function only in compression.

Figure 7:
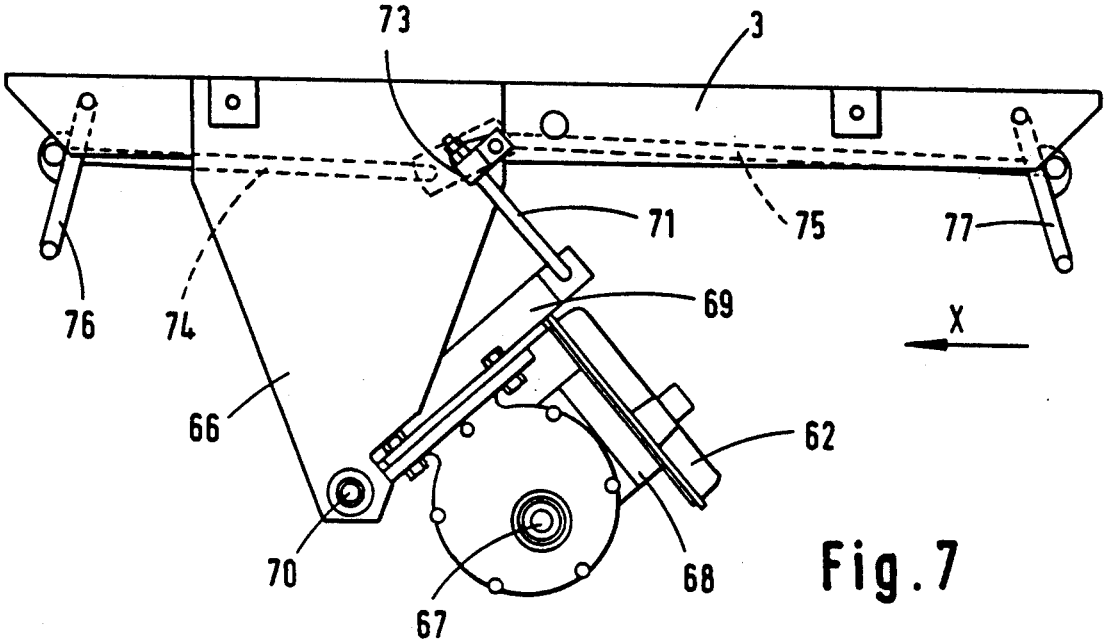
FIG. 7 is a side elevation of the attitude frame showing the manner in which the motor is mounted thereon.
Figure 8:
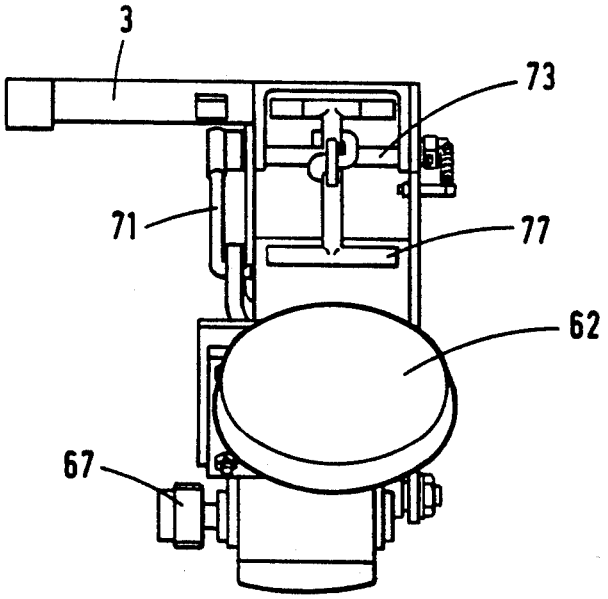
FIG. 8 is a view taken in the direction of the arrow X in FIG. 7.

The turning mechanism is shown in more detail in FIGS. 5, 7 & 8. In principle, a quadrant (64) is formed with toothing to form a curved rack and is fixedly attached to the A-frame (4). A motor (62) is carried by a supporting plate (66) which is fixed to the attitude frame (3). Motor (62) is arranged to drive a pinion (67) which is engageable with the curved rack of the quadrant (64) and the arrangement is such that with the pinion engaged with the rack, operation of the motor causes the attitude frame to turn about the axis of the trunnion (47).

In practice, the motor (62) includes a gear box (68) which reduces the speed of the pinion to an appropriate rate. It has been found that an appropriate speed for the pinion is about 2 rpm. In an emergency when it is desired to return the bed rapidly to the horizontal position, the pinion speed may be increased.

A DC electric motor is preferred for several reasons. First, the shaft speed has a linear relationship with the applied voltage. Therefore, the rate of turning can be accurately determined and controlled by regulation of the voltage. Secondly, the low voltages employed make the bed electrically safe. Thirdly, the bed can be operated by on-board batteries which makes the bed truly portable. Normally, a battery charger will be included and a rectifier for operating from a mains voltage supply. We currently prefer to employ a DC motor such as the "pancake" motors manufactured by Printed Motors Limited of Bordon, Hampshire, England. These motors deliver high torque at low speed, e.g. 900 rpm at 6 volts and exhibit an almost exactly linear speed/voltage relationship. Thus, the pivoting speed of the attitude frame can be controlled by connecting the turning motor (62) to the central processor board via the relay board and regulating the applied voltage in accordance with the programmed turning speed (see FIGS. 9 to 11).

The quadrant (64) is readily manufactured by flame cutting a disc of appropriate radius into four pieces and milling teeth to correspond with the setting of the pinion teeth.

The motor and gear box assembly (62 & 68) are bolted onto a supporting plate (69) which is itself pivotably mounted on bracket (66) by shaft (70). Connected to the end of plate (69) remote from shaft (70) is a push rod (71), the opposite end of which is clamped to one end of a shaft (73) mounted in a side cheek of the attitude frame (3). Shaft (73) can be rotated in a clockwise or anti-clockwise direction by pushing or pulling on rods (74 or 75) which are actuatable by levers (76 & 77), conveniently located at each side of the bed. Pulling on lever (76 or 77) will disengage the pinion (67) from the rack (64), so that in an emergency, the bed can be returned manually to a horizontal position. The engagement/disengagement mechanism provided by rods (74 & 75) and associated actuating rod (71) are linked by a shaft which moves over centre between two stable positions defining engaged an disengaged conditions of the motor and rack. When the motor is disengaged, the attitude frame (3) is held in a horizontal plane by the two compression springs (62A & 62B). However, for further security, a dog clutch may be mounted on the motor gear box and engage in an apertured bar so as to effectively lock the attitude frame to the A-Frame (4).

The control panel is shown in FIG. 9 and is mounted on the face 80 of control box 13 (see FIG. 2). This includes an electrical mains indicator E, a blower switch F and a CPR lever G. Operation of the CPR lever will cause air to be dumped from the main air feed from the blower, thus causing all sacs to deflate rapidly and the bellows to deflate. The CPR lever is also linked to the actuator control thus bringing the bed to horizontal. The screen A is the temperature adjustment and display and shows the temperature of air passing through the sacs. Knobs H are linked to the valves for air supply to the individual sections 22 to 25 and provide the control for individual pressure control to each group of sacs. However, all the air sacs can be simultaneously inflated to full blower output pressure by pulling out knob J. This is used for assisting the patient on and off the bed. Light B is a warning light and draws attention to an alarm warning in the corresponding position in the display panel C, (see also FIG. 10).

The bed includes a potentiometric tilt sensor manufactured by Penny & Giles, which sense the angle of the attitude frame and provides a feed back to the microprocessor unit. This operates in the same way as the contour angle sensors (18 & 19) mentioned above. The output from this sensor is the third analogue input indicated in FIG. 11. Alternatively, another type of pendulum sensor, e.g. a mercury switch, may be used. In this way, the maximum angle of tilting can be preset so that the bed frame will commence turning in the opposite direction once the maximum tilt angle has been reached. A delay may be selectable so that there is a variable dwell at some point in the sequence.

The control system for the bed is shown in the block diagram of FIG. 11. From FIG. 11, it will be seen that all controls, sensors and display devices are linked to the microprocessor control board, which controls the operation of all the functions of the bed.

Operation of the bed is divided into two main modes:

1. Standard Low Air Loss (LAL) system use,
2. Turning mode.

The system automatically enters operating mode 1 upon power up. In this mode the control system receives input from transducers which are displayed on the screen (see FIG. 10). Indicators to set desired pressures can be set in this mode from keypad input (101). Inputs from CPR switch, Power Loss and Full Inflate are also monitored in this mode. All hand control functions which control the beds standard functions, i.e. tilt, posture and high low are available.

Upon selection of turning mode the turning parameters can be set by keypad input (101), once parameters are set they are displayed. The system checks all safety switches and if found to be correct, turning can begin. While turning is in progress all inputs including CPR Power Loss and Full Inflate are continually monitored. In this mode, the Hand Control functions may be inhibited to allow the bed to turn safely within pre-set limits. If these pre-set limits are exceeded, advisory messages are also displayed to indicate which fault conditions exist. Alarm messages are also displayed if the various alarm conditions are met.

During the turning cycle the bed can be stopped from turning or the dwell-time can be frozen to allow a nursing procedure to take place. The bed can then be restarted to continue its last operation or returned to a level position.

The cycle of automatic turning and dwell time continues until either a keypad input returns the bed to Mode 1 or the CPR switch is operated.

In order to avoid problems arising from the attitude frame being impeded by obstructions such as furniture or visitors, the attitude frame is fitted with a circumferential D-section inflated tube. This tube is connected to a pressure sensitive switch which is activated when the tube presses against an obstruction and therefore increases the pressure in the tube. On activation the switch sends a signal to the microprocessor which in turn causes the turning motor to reverse and thus move away from the obstruction. Simultaneously, the display panel will indicate the presence of an obstruction. Instead of an inflated tube, an infra-red detector may be used.

The control system includes a third mode called the maintenance or service mode. In this mode, the microprocessor is programmed to check the operating functions of the bed and to indicate in the display panel A any malfunctions.

As indicated in FIG. 11, the control means includes an output port and an ancillary printer or recording device (e.g. a tape cassette). This enables the clinician or nurse to print out from the microprocessor store, data concerning the sequences which the bed has performed, e.g. over the last few hours or days and provides a record of the treatment.

We claim:

1. A therapeutic bed which comprises:

(a) a trolley frame having floor-engaging feet or wheels, (b) an attitude frame pivotably mounted on a trolley frame so as to be pivotable in a turning movement through a predetermined arc about an axis extending longitudinally of the bed, (c) operating means for causing the attitude frame to pivot through said predetermined arc, (d) a plurality of air sacs supported on said attitude frame and inflatable to a pressure sufficient to provide a resilient surface for supporting a patient thereon, said air sacs together forming a shaped cavity within which the patient's body can be nested and supported so that the patient does not slide off the bed during the turning movement of said attitude frame, each of said air sacs individually extending across at least a full horizontal section of the patient's body and individually forming a shaped cavity within which the horizontal section can be nested and supported both laterally and vertically, and (e) control means for causing the turning movement in one direction of the attitude frame to be arrested in an inclined position when reaching the end of the predetermined movement in one direction and causing the operating means to reverse the direction of turning movement.

2. A bed as claimed in claim 1 wherein the control means includes means for adjusting the rat, angle of turning and/or dwell time in the inclined position before reversing the direction of turning.

3. A therapeutic bed as claimed in claim 1 wherein the operating means for causing the attitude frame to pivot comprises a motor fixedly mounted relative to one component selected from the attitude frame and the trolley frame and drivably connected through gearing to the other component of the trolley frame and the attitude frame.

4. A bed as claimed in claim 3 wherein the operating means comprises a motor drivably connected to a pinion, said pinion being engageable with a toothed wheel or quadrant.

5. A bed as claimed in claim 4 wherein the pinion is disengageable from the wheel or quadrant so that in an emergency the bed can be pivoted manually to a flat position and locked therein.

6. A bed as claimed in claim 1 wherein the attitude frame is also tiltable about one or more axes extending transversely of the bed so that the foot or head of the bed may be raised or lowered.

7. A bed according to claim 6 which includes actuating means for raising and lowering the head or foot end of the bed, said actuating means being linked with said operating means by control means which prevents commencement of pivoting of the attitude frame about said longitudinal axis when the head or front end is elevated over a set angle.

8. A bed as claimed in claim 1 additionally including means for sensing the attitude of said attitude frame and determining when said attitude frame has reached the end of its predetermined movement in each direction, said control means being responsive to said sensing means.

9. A bed as claimed in claim 1 additionally including an emergency switch which, upon actuation, causes deflation of said air sacs and causes said operating means to pivot said attitude frame as necessary to bring it to a horizontal attitude.

* * * * *